United States Patent [19]

Watanabe

[11] Patent Number: 4,479,372

[45] Date of Patent: Oct. 30, 1984

[54] METHOD OF MANUFACTURING METALLIC BENT PIPE

[75] Inventor: Yasuo Watanabe, Kawasaki, Japan

[73] Assignee: Dai-Ichi High Frequency Co., Ltd., Kanagawa, Japan

[21] Appl. No.: 522,586

[22] Filed: Aug. 12, 1983

[30] Foreign Application Priority Data

Sep. 3, 1982 [JP] Japan ..... 57-152655

[51] Int. Cl.[3] ..... B21D 7/16

[52] U.S. Cl. ..... 72/128; 72/369

[58] Field of Search ..... 72/128, 149, 342, 364, 72/369

[56] References Cited

U.S. PATENT DOCUMENTS

| | | | |
|---|---|---|---|
| 2,286,893 | 6/1942 | Boissou | 72/369 X |
| 3,958,438 | 5/1976 | Somov et al. | 72/128 |
| 4,006,621 | 2/1977 | Moshnin et al. | 72/151 |
| 4,151,732 | 5/1979 | Hofstede et al. | 72/128 X |
| 4,195,506 | 4/1980 | Kawanami et al. | 72/128 X |
| 4,254,649 | 3/1981 | Cervenka et al. | 72/128 |

*Primary Examiner*—E. Michael Combs

*Attorney, Agent, or Firm*—L. Lawton Rogers, III

[57] ABSTRACT

A method capable of continuously manufacturing a metallic bent pipe having straight pipe portions at both ends of a bent pipe portion which have been subjected to the same heat treatment as that for the bent pipe portion. The method comprises the steps of: inserting the front end portion of a metallic pipe to be bent into a heating device, and advancing the pipe, with the travel of the heating device suspended, thereby to heat-treat the pipe; retracting the heating device and advancing the pipe to heat-treat the same; suspending the advance of the pipe while retracting the heating device thereby to heat-treat the pipe, and clamping the pipe by a bending operation part; suspending the retraction of the heating device and advancing the pipe as well as applying a bending moment to the pipe thereby to bend the same; suspending the advance of the pipe and heat-treating the same while retracting the heating device, and releasing the pipe from the bending operation part; retracting the heating device and advancing the pipe to heat-treat the same; and suspending the retraction of the heating device and moving the pipe to heat-treat the same.

12 Claims, 10 Drawing Figures

METHOD OF MANUFACTURING METALLIC BENT PIPE

BACKGROUND OF THE INVENTION

1. Field of the Invention

The present invention relates to a method of continuously manufacturing a metallic bent pipe having straight pipe portions at both ends of a bent pipe portion, which have been subjected to the same heat treatment as that for the bent pipe portion.

2. Description of the Prior Art

It is desirable to employ what is called a winged bent pipe, which has straight pipe portions at both ends of a bent pipe portion which have been subjected to the same heat treatment as that for the bent pipe portion, as a metallic pipe required to have a high strength and a high toughness such as a pipe employed for a bent portion of a pipeline laid in a sea area under severe natural conditions or a northernmost cold zone or a pipe for a pipeline required to cope with a transporting pressure having recently been raised in order to increase the quantity of transportation. The reason therefor is that in case of carrying out edge preparation or butt welding, the operation is extremely easy, since not the bent pipe portion but the straight pipe portions are subjected to such a processing to conduct the operation. Moreover, when a welding defect occurs at a welded joint after welding, the defective portion is generally cut off and welding is carried out again. Also in such a case, a straight pipe portion is subjected to such operations; hence, the operations are extremely easy.

Further, in the piping used for a nuclear reactor or other piping, a stainless steel pipe is generally subjected to heat treatment such as solid solution treatment in order to improve reliability. In such a case, if the heat treatment can be applied to not only a bent pipe portion but also straight pipe portions leading thereto continuously in one step, any discontinuous heat treatment is eliminated, so that it is possible to further improve reliability.

Hitherto, it has been known that heat treatment permits a steel pipe to be higher in strength and toughness, resulting in a steel pipe having a high quality level. As the method of heat-treating a straight steel pipe over its overall length, such a method has been known that a heating means such as a high-frequency induction heater is disposed on the longitudinal front end portion of a steel pipe, and while the pipe is being heated in an annular zone by the heating means, the heater is relatively moved toward the rear end portion of the pipe, thereby to properly cool the heated portion. On the other hand, as the method of bending a steel pipe such as mentioned above, such a method has been known that a portion of the pipe to be bent is annularly and locally heated by the above-mentioned heating means and cooled immediately after the heating, and while the heating zone is being relatively moved in the longitudinal direction of the pipe, the pipe is transformed by applying a bending moment thereto. The bent pipe portion bent by this method is subjected to heat treatment simultaneously with the bending processing.

Thus, a metallic bent pipe having straight pipe portions at both ends of a bent pipe portion which have been subjected to the same heat treatment as that for the bent pipe portion is conventionally manufactured as follows. After a bent pipe portion is formed by bending processing according to a method such as described above, straight pipe portions are subjected to heat treatment by a method such as described above, or all the pipe portions except for a portion to be a bent pipe portion are previously heat-treated by the above-mentioned method and then the straight pipe portion to be a bent pipe portion is bent by the above-mentioned method. These conventional methods, however, disadvantageously require two steps, i.e., the bending processing and the heat treatment for the straight pipe portions. Moreover, it is extremely difficult for these conventional methods to uniform the heat-treatment conditions of the joining portions between the bent pipe portion and the straight pipe portions or the conditions of the advancing heat-treated portion and the subsequent heat-treated portion.

Accordingly, in order to manufacture such a metallic bent pipe having straight pipe portions at both ends of a bent pipe portion which have been subjected to the same heat treatment as that for the bent pipe portion, it is desirable to apply heat treatment to the straight pipe portions while subjecting the pipe to bending processing. However, although the straight pipe portions can be heat-treated simply by fixing either the pipe or the heating means and moving the other and then cooling the heated portion, the bending processing generates an extremely large bending moment to the pipe, causing a large load to be applied to a clamp support for the pipe. Therefore, since the support for the pipe is constructed as a rigid body capable of sufficiently bearing this load and has a certain size with respect to the longitudinal direction of the pipe, it is necessary to remove and remount the pipe clamp to shift the heat-treatment zone the straight pipe portions to the bending portion or from the bending portion to the straight pipe portions. Accordingly, it is essential to devise such that the variation in load in accordance with the removal and remounting of the pipe clamp will not adversely affect the bending processing or the heat treatment. Therefore, there are still many problems to be solved in order to continuously carry out the manufacture of a metallic bent pipe such as mentioned above.

However, if such a method is developed which is capable of continuously manufacturing a metallic bent pipe having straight pipe portions at both ends of a bent pipe portion, which have been subjected to the same heat treatment as that for the bent pipe portion, the method is exceedingly useful from the industrial viewpoint.

SUMMARY OF THE INVENTION

Accordingly, a primary object of the invention is to provide a method capable of continuously manufacturing a metallic bent pipe having straight pipe portions at both ends of a bent pipe portion which have been subjected to the same heat treatment as that for the bent pipe portion.

The above and other objects and features of the invention will become apparent from the claims and the following description when read in conjunction with the accompanying drawings.

DESCRIPTION OF THE PREFERRED EMBODIMENT

An embodiment of the invention will be described hereinunder.

Figure 1:
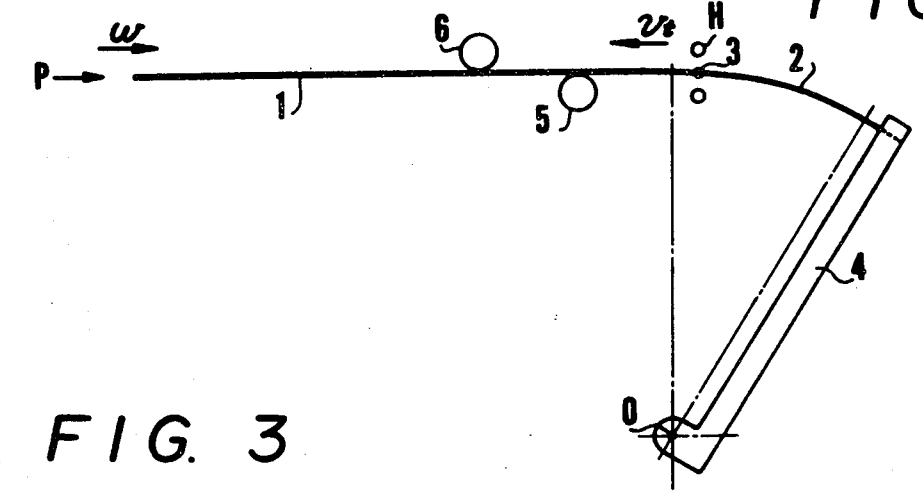
FIG. 1 is an example of a skeleton diagram showing the state where a metallic bent pipe is bent by a hot pipe-bending apparatus convenient for description of the principle of a method of manufacturing a metallic bent pipe in accordance with the invention.

Referring now to FIG. 1 which is an example of a skeleton diagram showing the state where a metallic bent pipe is bent by a hot pipe-bending apparatus convenient for description of the principle of the invention, a reference numeral 1 denotes a pipe to be bent, while a reference numeral 2 designates a bent pipe portion formed by bending the pipe 1. A heating device H comprises a high-frequency induction heater or the like integrally provided with a cooling device. A reference numeral 3 represents the center of the heating zone, while a reference numeral 4 denotes a bending arm which clamps the front end of the pipe 1 and is rotatable about a bending central point O. Moreover, reference numerals 5, 6 designate guide rollers for supporting and guiding the pipe 1.

Figure 3:
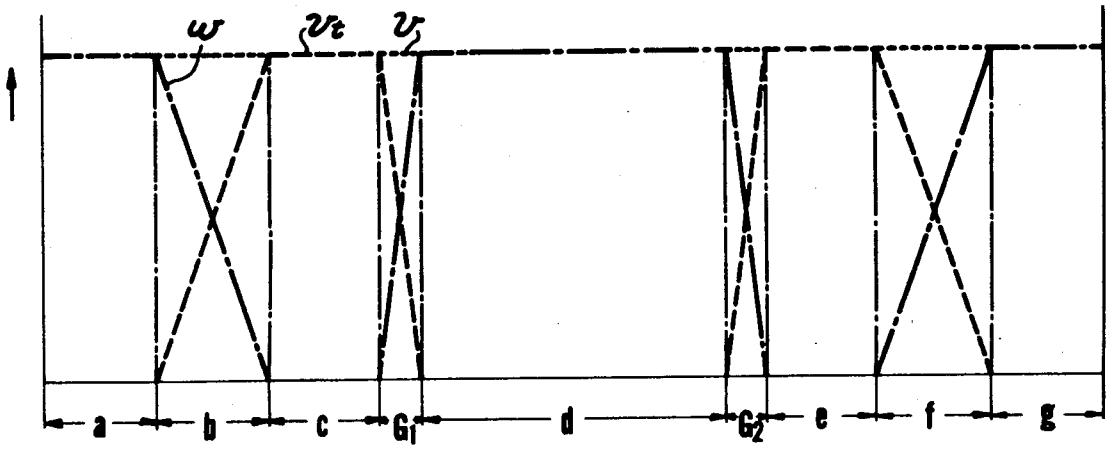
FIG. 3 illustrates the state where the traveling speed of a pipe and that of a heating means are linearly varied with respect to time while the relative speed therebetween is maintained constant at all times.
Figure 2:
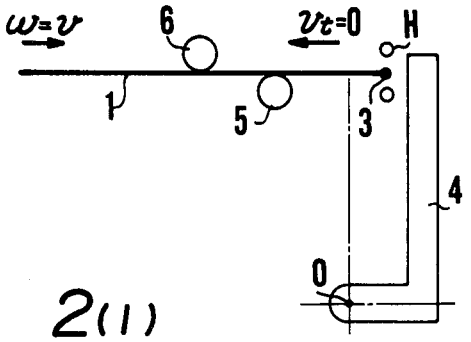
FIGS. 2(1) through 2(8) show the states of heat treatment and bending processing respectively, in the operating order, in accordance with an embodiment of the invention employing the apparatus shown in FIG. 1.
Figure 2:
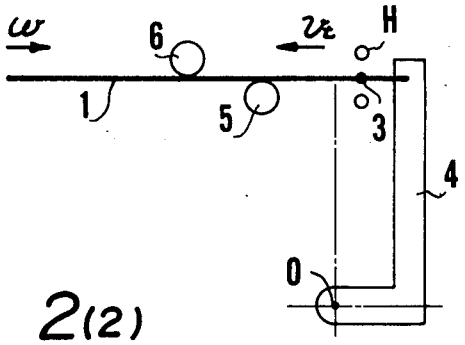
Figure 2:
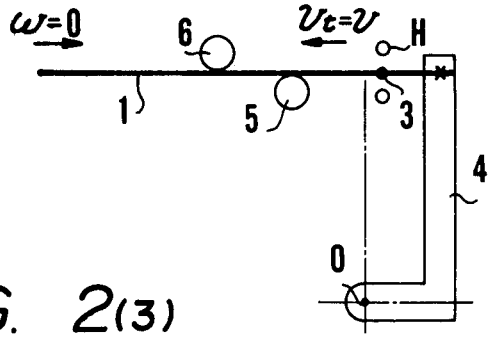
Figure 2:
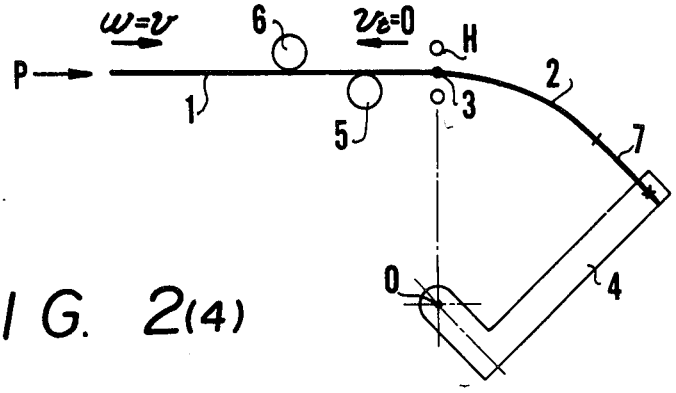
Figure 2:
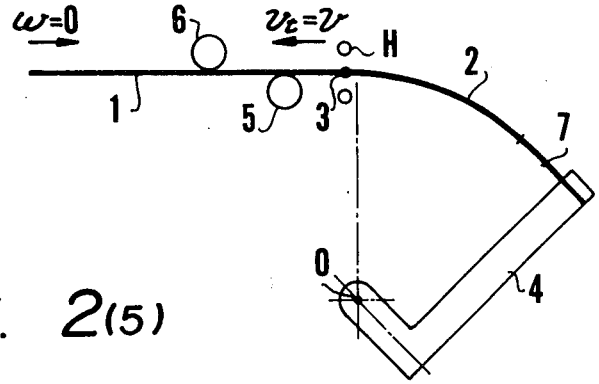
Figure 2:
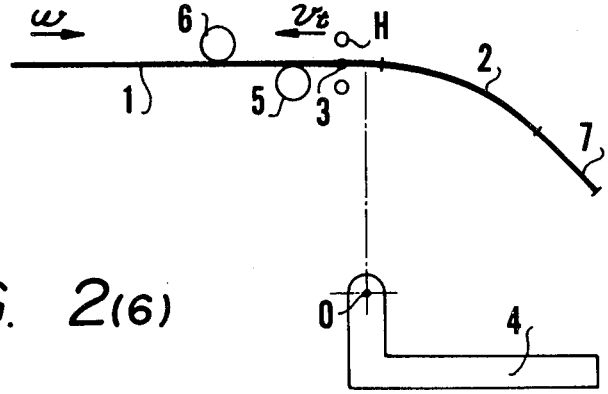
Figure 2:
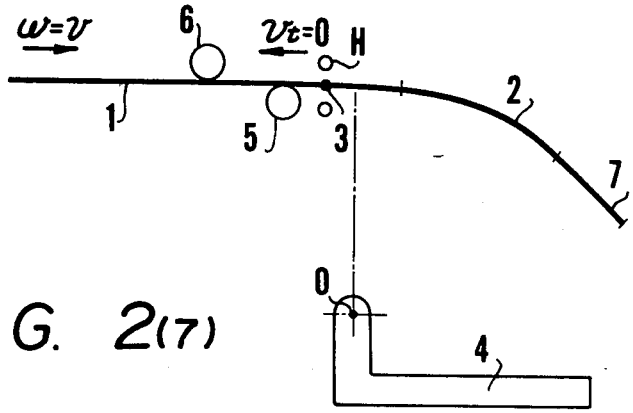
Figure 2:
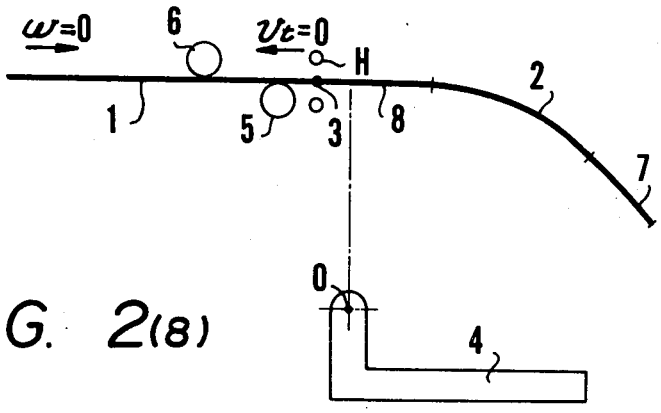

FIG. 2 shows the states of heat treatment and bending processing, in the operating order, in accordance with the embodiment of the invention employing the apparatus shown in FIG. 1, while FIG. 3 illustrates the state where the traveling speed w of the pipe 1 and the traveling speed vt of the heating device H are linearly varied with respect to time while the relative speed v therebetween is maintained constant at all times.

In carrying out the invention, in order to apply heat treatment to the straight pipe portion at the front end portion of the pipe 1, the heating device H is previously moved toward the front end of the pipe 1 by a proper distance from the intersection between the pipe 1 and a perpendicular for the pipe passing through the bending central point O and is made to stand by at the position. The operation is started under this state.

Steps will be described hereinunder in due order.

(1) A step of moving the pipe 1, with the travel of the heating device H suspended, to effect heat treatment (see FIG. 2(1) and a section a of FIG. 3).

Under the above-mentioned standby state, the front end portion of the pipe 1 is inserted in the heating device H as shown in FIG. 2(1). Under this state, the heating device H is actuated, and only the pipe 1 is advanced at the relative speed v as shown in the section a of FIG. 3 thereby to heat-treat the pipe 1.

(2) A step of advancing the pipe 1 while retracting the heating device H thereby to heat-treat the pipe 1 (see FIG. 2(2) and a section b of FIG. 3).

After the pipe 1 is advanced by a proper distance in the previous step, the traveling speed of the pipe 1 is reduced as shown in the section b of FIG. 3 and at the same time, the heating device H is retracted so that the relative traveling speed to the pipe 1 will be v at all times, thereby to heat-treat the pipe 1.

(3) A step of suspending the travel of the pipe 1 while retracting the heating device H thereby to heat-treat the pipe 1, and clamping the pipe 1 by the bending processing part, i.e., the bending arm 4 (see FIG. 2(3) and a section c of FIG. 3).

When the retracting speed of the heating device H reaches the relative speed v as shown in the section c of FIG. 3, the travel of the pipe 1 is suspended, and only the heating device H is retracted at the relative speed v to continue the heat treatment. On the other hand, the front portion of the pipe 1 suspended is clamped by the bending arm 4 as indicated by a symbol x in FIG. 2(3).

(4) A step of suspending the travel of the heating device H and advancing the pipe 1 as well as applying a bending moment thereto thereby to bend the pipe 1 (see FIG. 2(4) and sections $G_1$ and d of FIG. 3).

When the heating device H being retracted in the previous step further travels at the relative speed v thereby to heat-treat a desired straight pipe portion 7 and reaches a position near the intersection between the pipe 1 and the perpendicular for pipe passing through the bending central point O, the travel of the heating device H is suspended as shown in the section $G_1$ of FIG. 3 and at the same time, the pipe 1 is advanced again at the relative speed v by thrusting force P in oder to apply a bending moment to the pipe 1 to bend the same as shown in FIG. 2(4) and the section d of FIG. 3 thereby to form a desired heat-treated bent pipe portion 2.

(5) A step of suspending the travel of the pipe 1 and heat-treating the same while retracting the heating device H and releasing the pipe 1 from the clamp of the bending arm 4 (see FIG. 2(5) and sections $G_2$ and e of FIG. 3).

After the bent pipe portion 2 is formed by the previous step, the advance of the pipe 1 is suspended as shown in the section $G_2$ of FIG. 3 and at the same time, the heating device H is retracted at the relative speed v to continue the heat treatment. On the other hand, the front end portion of the pipe 1 clamped by the bending arm 4 in the (3) step is released as shown in FIG. 2(5).

(6) A step of retracting the heating device H and advancing the pipe 1 to heat-treat the same (see FIG. 2(6) and a section f of FIG. 3).

When a predetermined time has passed after the retraction of the heating device H at the relative speed v in the previous step, the traveling speed of the heating device H is reduced as shown in the section f of FIG. 3 and at the same time, the pipe 1 is heat-treated while being advanced so that the relative traveling speed to the heating device H will be v at all times, as shown in FIG. 2(6).

(7) A step of suspending the travel of the heating device H and advancing the pipe 1 to heat-treat the same (see FIG. 2(7) and a section g of FIG. 3).

When the retraction of the heating device H in the previous step is suspended, the pipe 1 is advanced at the relative speed v as shown in FIG. 2(7) and the section g of FIG. 3. When a desired heat-treated straight pipe portion 8 is obtained, the travel of the pipe 1 is suspended and also the operation of the heating device H is suspended, as shown in FIG. 2(8).

Thus, it is possible to manufacture a winged metallic bent pipe having the straight pipe portions 7, 8 at both ends of the bent pipe portion 3 which have been subjected to the same heat treatment as that for the bent pipe portion 3.

It is to be noted that the period of each of the sections $G_1$, $G_2$ of FIG. 3 is only required to be set so as not to affect the heat treatment in the ordinary bending processing, since the period thereof has an effect on the shifting state of the bending radius at each of the boundaries between the straight pipe protions 7, 8 and the bent pipe portion 3. Also in such a case, it is, as a matter of course, necessary to maintain the relative speed between the metallic pipe and the heating device constant.

Moreover, since the straight pipe portions require a smaller force in processing than the bent pipe portion, the processing speed can be increased. In his case, however, the ratio between the relative speed between the pipe and the heating device and the quantity of heat supplied per unit time is made constant. Thus, in the case where the pipe has a large thermal capacity, such as a pipe having a large wall thickness, and hence has large effects of heat conduction, heat dissipation and heating depth, there are also cases where it is difficult to maintain the heating temperature. Therefore, the change in heating temperature of an essential part is detected, and control is effected so that the change in heating temperature will be within a range that has no hindrance to processing.

Although the operation in each of the above-described steps is seemingly complicated, the steps can simply be embodied by effecting a proper control such as program control.

As will be fully understood from the foregoing description, the invention permits manufacture of what is called a winged metallic bent pipe having the whole thereof subjected to a uniform heat treatment continuously, easily as well as at low cost and with high accuracy, which is conventionally difficult. Accordingly, the invention is exceedingly useful from the industrial viewpoint.

Although the invention has been described throug specific terms, it is to be noted here that the described embodiment is not exclusive and various changes and modifications may be imparted thereto without departing from the scope of the invention which is solely limited by the appended claims.

What is claimed is:

1. A method of manufacturing a metallic bent pipe having straight pipe portions at both ends of a bent pipe center portion and having the entire pipe subjected to heat treatment by employing an apparatus which effects bending processing such that a metallic pipe to be bent is locally heated by an annular heating device provided with a cooling device and cooled immediately after the heating, and a bending moment is applied to said center portion of the pipe while said heating device is being relatively moved in the longitudinal direction of said pipe thereby to simultaneously bend and heat-treat said pipe, comprising the steps of:

inserting the front end portion of said pipe into said heating device mounted for travel a predetermined distance forward and rearward in the longitudinal direction of said pipe, and advancing said pipe with the travel of said heating device suspended, thereby to heat-treat a first section of said front end portion of said pipe;

retracting said heating device and advancing said pipe to heat-treat a second section of said front end portion of said pipe;

suspending the advance of said pipe while retracting said heating device thereby to heat-treat a third section of said front portion of said pipe while clamping the leading end of said center portion of said pipe by a bending device;

suspending the retraction of said heating device and advancing said pipe while applying a bending moment to said center portion thereby to bend the same;

suspending the advance of said pipe while retracting said heating device to thereby heat-treat a first section of the rear portion of said pipe, and releasing said pipe from said bending device;

retracting said heating device and advancing said pipe to heat-treat a second section of said rear portion of said pipe; and suspending the retraction of said heating device and moving said pipe to heat-treat a third section of said rear portion of said pipe, wherein all of the steps are carried out continuously while maintaining substantially constant the ratio between (a) the relative speed between said pipe and heating device and (b) the quantity of heat supplied per unit time in each of the steps.

2. A method of manufacturing a metallic bent pipe according to claim 1, wherein the relative speed between said pipe and heating device is maintained substantially constant, and wherein the quantity of heat supplied per unit time is maintained substantially constant.

3. A method of manufacturing a metallic bent pipe according to claim 1 wherein during the traveling of said heating device and pipe, the change in heating temperature is detected, and said change is controlled to be within a predetermined range compatible with both heat treatment and bending.

4. A method of manufacturing a metallic bent pipe having straight pipe portions on both ends of a bent center portion comprising the steps of:

(a) providing a heat treating device and a bending device;

(b) inserting one end of the pipe into the heating device;

(c) moving the pipe relative to the heating device to heat-treat a first section thereof;

(d) moving the heat treating device relative to the pipe to het-treat a second section thereof while attaching the bending device to the pipe;

(e) moving the pipe relative to the heat treating device to simultaneously heat-treat a third section thereof and bend the third section;

(f) moving the heat treating device relative to the pipe to heat-treat a fourth section thereof while detaching the bending device from the pipe; and (g) moving the pipe relative to the heat treating device to heat-treat a fifth section of the pipe, whereby the entire pipe is heat treated as it is manufactured.

5. The method of claim 4 including the step of maintaining a substantially constant ratio between (a) the relative speed between the pipe and the heat treating device and (b) the amount of heat per unit time.

6. The method of claim 5 wherein the relative speed between the pipe and the heat treating device is substantially constant.

7. The method of claim 6 including the further step of maintaining the amount of heat per unit time within a preselected range of values.

8. The method of claim 4 including the further step of maintaining the amount of heat per unit time within a preselected range of values.

9. The method of claim 4 including the further steps of smoothing the transition between steps (c) and (d) and between steps (f) and (g) by moving both the pipe and the heat treating device without substantially changing the relative speed.

10. The method of claim 9 including the step of maintaining a substantially constant ratio between (a) the relative speed between the pipe and the heat treating device and (b) the amount of heat per unit time.

11. The method of claim 10 wherein the relative speed between the pipe and the heat treating device is substantially constant.

12. The method of claim 11 including the further step of maintaining the amount of heat per unit time within a preselected range of values.

* * * * *